US006176686B1

(12) United States Patent
Wallis et al.

(10) Patent No.: US 6,176,686 B1
(45) Date of Patent: Jan. 23, 2001

(54) SCROLL MACHINE WITH CAPACITY MODULATION

(75) Inventors: Frank S. Wallis; Stanley P. Schumann, both of Sidney; Jeffrey L. Berning, Fort Loramie, all of OH (US)

(73) Assignee: Copeland Corporation, Sidney, OH (US)

( * ) Notice: Under 35 U.S.C. 154(b), the term of this patent shall be extended for 0 days.

(21) Appl. No.: 09/253,570

(22) Filed: Feb. 19, 1999

(51) Int. Cl.[7] ..... F04B 49/00
(52) U.S. Cl. ..... 417/310
(58) Field of Search ..... 417/310, 299

(56) References Cited

U.S. PATENT DOCUMENTS

| | | |
|---|---|---|
| 4,383,805 | 5/1983 | Teegarden et al. . |
| 4,456,435 | 6/1984 | Hiraga et al. . |
| 4,468,178 | 8/1984 | Hiraga et al. . |
| 4,497,615 | 2/1985 | Griffith . |
| 4,514,150 | 4/1985 | Hiraga et al. . |
| 4,566,863 | 1/1986 | Goto et al. . |
| 4,673,340 | 6/1987 | Mabe et al. . |
| 4,747,756 | 5/1988 | Sato et al. . |
| 5,074,760 | 12/1991 | Hirooka et al. . |
| 5,074,761 | 12/1991 | Hirooka et al. . |
| 5,192,195 | 3/1993 | Iio et al. . |
| 5,451,146 | 9/1995 | Inagaki et al. . |
| 5,551,846 | 9/1996 | Taylor et al. . |
| 5,562,426 | 10/1996 | Watanabe et al. . |
| 5,678,985 | 10/1997 | Brooke et al. . |

FOREIGN PATENT DOCUMENTS

| | | |
|---|---|---|
| 35 14230 A1 | 10/1986 | (DE) . |
| 0 060 140 A1 | 9/1982 | (EP) . |
| 0 174 516 A1 | 3/1986 | (EP) . |
| 0 747 597 A2 | 6/1995 | (EP) . |
| 0 681 105 A2 | 11/1995 | (EP) . |
| 3-202691 | 9/1991 | (JP) . |

*Primary Examiner*—Teresa Walberg
*Assistant Examiner*—Vinod D Patel
(74) *Attorney, Agent, or Firm*—Harness, Dickey & Pierce, P.L.C.

(57) ABSTRACT

A scroll-type refrigeration compressor is disclosed which incorporates an efficient, reliable, low cost modulation system employing a single actuator to effect switching between full and reduced capacity operation. The modulation system of the present invention includes an elongated member movably supported on the non-orbiting scroll which operates to ensure simultaneous opening and closing one or more unloading passages thus avoiding the possibility of even transient pressure imbalances between opposed compression pockets during operation of the compressor. In one embodiment, the elongated member has the opposite ends interconnected by springs and is rotatably movable to effect the intended modulation. In another embodiment, the elongated member is movable generally along a radial line of the non-orbiting scroll member. Further, the modulation system of the present invention provides for reduced capacity at both start up and shut down thus enabling the use of more efficient lower starting torque motors and reducing the potential for noise generating reverse rotation on shut down.

19 Claims, 4 Drawing Sheets

Fig. 6.
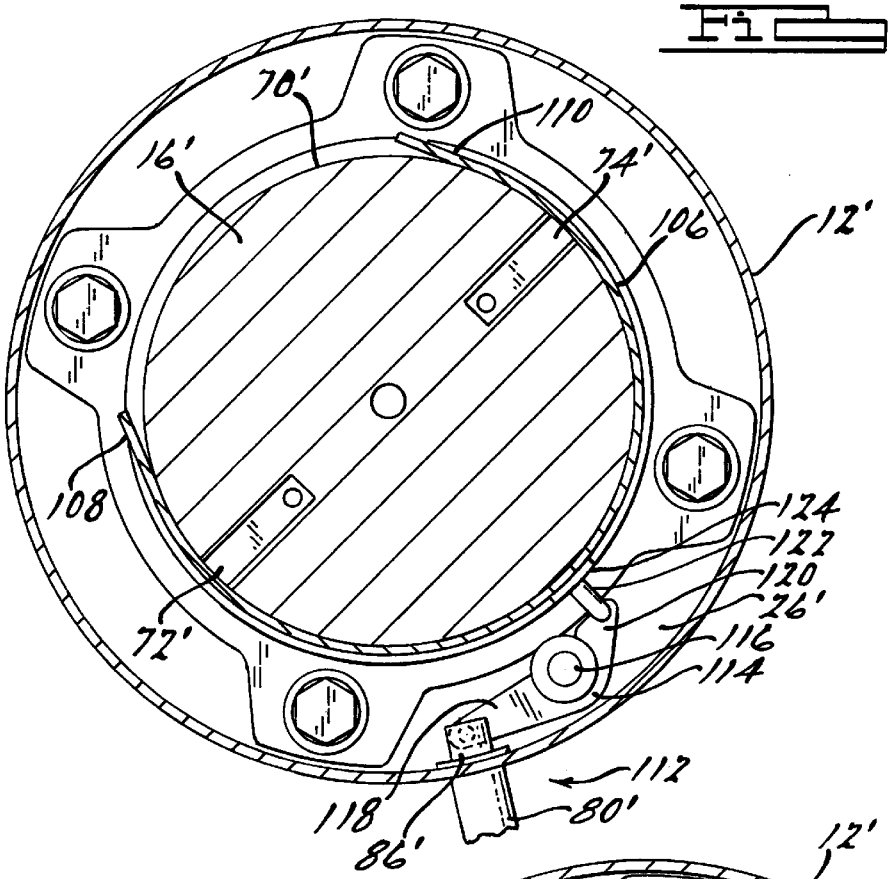
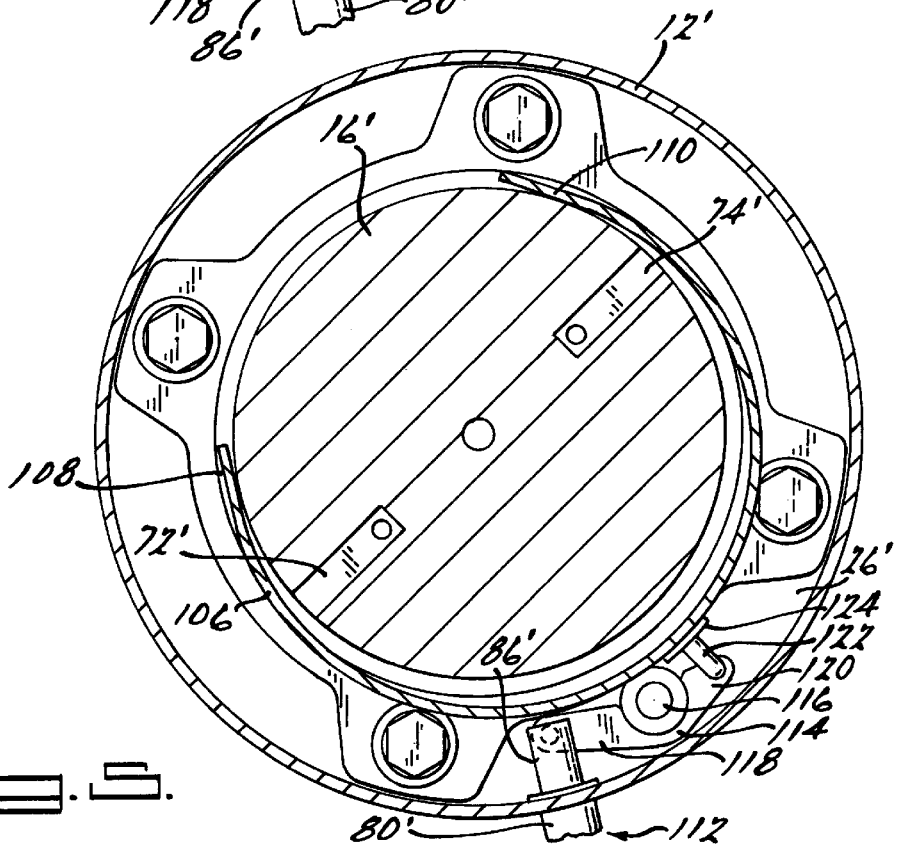
Fig. 5.

SCROLL MACHINE WITH CAPACITY MODULATION

BACKGROUND AND SUMMARY OF THE INVENTION

The present invention relates generally to scroll compressors and more specifically to a capacity modulation system of the delayed suction type for such compressors.

Refrigeration and air conditioning systems are commonly operated under a wide range of loading conditions due to changing environmental conditions. In order to effectively and efficiently accomplish the desired cooling under such changing conditions, it is desirable to incorporate means to vary the capacity of the compressors utilized in such systems.

A wide variety of systems have been developed in order to accomplish this capacity modulation most of which delay the initial sealing point of the moving fluid pockets defined by scroll members. In one form, such systems commonly employ a pair of vent passages communicating between suction pressure and the outermost pair of moving fluid pockets. Typically these passages open into the moving fluid pockets at a position normally within 360° of the sealing point of the outer ends of the wraps. Some systems employ a separate valve member for each such vent passage which valves are intended to be operated simultaneously so as to ensure a pressure balance between the two fluid pockets. Other systems employ additional passages to place the two vent passages in fluid communication thereby enabling use of a single valve to control capacity modulation.

The first type of system mentioned above creates a possibility that the two valves may not operate simultaneously. For example, should one of the two valves fail, a pressure imbalance will be created between the two fluid pockets which will increase the stresses on the Oldham coupling thereby reducing the life of the compressor. Further, such pressure imbalance may result in increasing operating noise to an unacceptable level. Even slight differences in the speed of operation between the two valves can result in objectionable noise generating transient pressure imbalances.

While the second type of system mentioned above eliminates the concern over pressure imbalances encountered with the first system, it requires additional costly machining to provide a linking passage across the scroll end plate to interconnect the two vent passages. Further, the addition of this linking passage increases the re-expansion volume of the compressor when it is operated in a full capacity mode thus reducing its efficiency.

The present invention, however, overcomes these and other problems by providing a single valving ring operated by a single actuator so as to ensure simultaneous opening and closing of the vent passages thus avoiding any possibility of even transient pressure imbalances in the fluid pockets. The valving ring of the present invention is in the form of a discontinuous generally circularly shaped ring which in one embodiment is rotatably mounted on the non-orbiting scroll member and includes portions operative to open and close, one, two or more vent passages simultaneously. In another embodiment the ring may be moved in a generally radial direction. Actuation of the valving ring is preferably accomplished by means of a solenoid valve although a fluid pressure operated actuator may be used. In both of the embodiments a minimum number of parts are required to accomplish the capacity modulation. Further, the capacity modulation system of the present invention will preferably be designed such that the compressor will be in a reduced capacity mode at both start up and shut down. The reduced capacity starting mode reduces the required starting torque because the compressor is compressing a substantially smaller volume of refrigerant. This reduced starting torque enables use of a lower torque higher efficiency motor. Also, reduced capacity operation at shut down reduces the potential and degree of noise generating reverse rotation of the scrolls thereby enhancing customer satisfaction. Additionally, the system of the present invention is preferably designed such that should the actuating system fail, the compressor will be able to continue operation in a reduced or modulated capacity mode. This is desirable because under normally encountered operating conditions, the compressor will spend most of its running time in the modulated or reduced capacity mode.

Additional advantages and features of the present invention will become apparent from the subsequent description and the appended claims taken in conjunction with the accompanying drawings.

BRIEF DESCRIPTION OF THE DRAWINGS

FIGS. 5 and 6 are section views each similar to that of FIG. 2 but showing another embodiment of the present invention in open and closed positions respectively.

DESCRIPTION OF THE PREFERRED EMBODIMENTS

Figure 1:
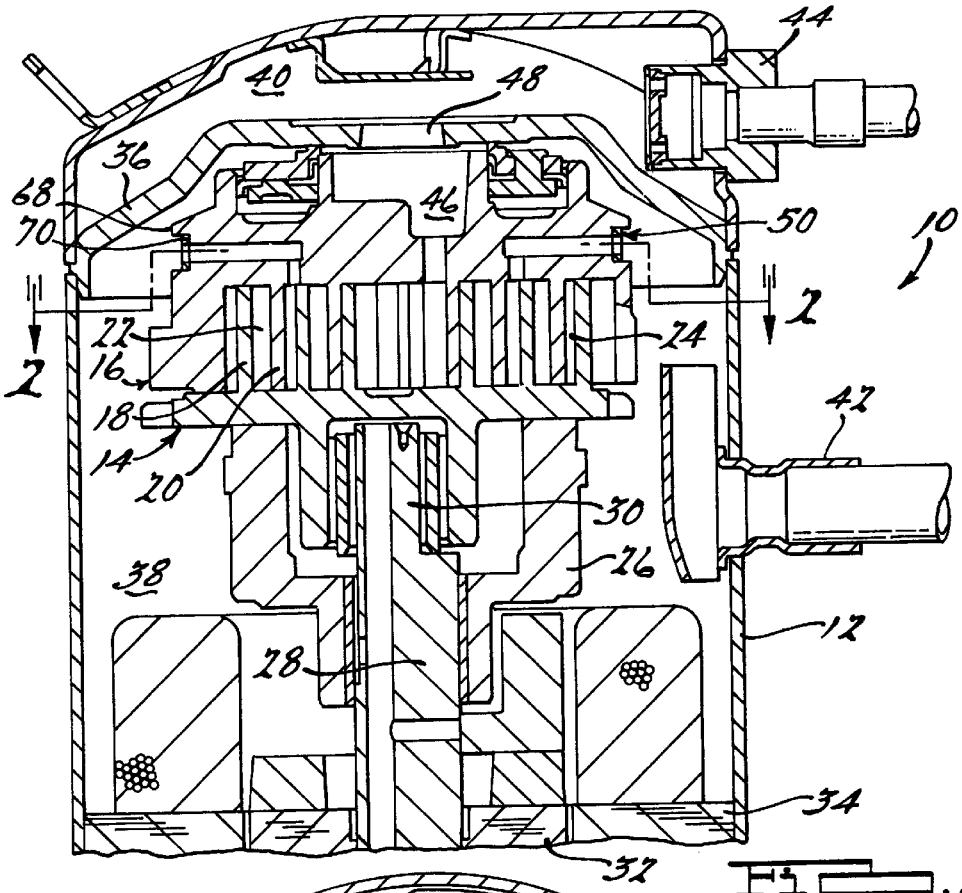
FIG. 1 is a fragmentary section view of a hermetic scroll compressor incorporating the capacity modulation system of the present invention.

Referring now to the drawings and in particular to FIG. 1, there is shown a hermetic scroll-type refrigeration compressor indicated generally at 10 and incorporating a capacity modulation system in accordance with the present invention.

Compressor 10 is generally of the type disclosed in U.S. Pat. No. 4,767,293 issued Aug. 30, 1988 and assigned to the same assignee as the present application the disclosure of which is hereby incorporated by reference. Compressor 10 includes an outer shell 12 within which is disposed orbiting and non-orbiting scroll members 14 and 16 each of which include upstanding interleaved spiral wraps 18 and 20 which define moving fluid pockets 22, 24 which progressively decrease in size as they move inwardly from the outer periphery of the scroll members 14 and 16.

A main bearing housing 26 is provided which is supported by outer shell 12 and which in turn movably supports orbiting scroll member 14 for relative orbital movement with respect to non-orbiting scroll member 16. Non-orbiting scroll member 16 is supported by and secured to main bearing housing for limited axial movement with respect thereto in a suitable manner such as disclosed in U.S. Pat. No. 5,407,335 issued Apr. 18, 1995 and assigned to the same assignee as the present application, the disclosure of which is hereby incorporated by reference.

A drive shaft 28 is rotatably supported by main bearing housing 26 and includes an eccentric pin 30 at the upper end thereof drivingly connected to orbiting scroll member 14. A motor rotor 32 is secured to the lower end of drive shaft 28 and cooperates with a stator 34 supported by outer shell 12 to rotatably drive shaft 28.

Outer shell 12 includes a muffler plate 36 which divides the interior thereof into a first lower chamber 38 at substantially suction pressure and an upper chamber 40 at discharge pressure. A suction inlet 42 is provided opening into lower chamber 38 for supplying refrigerant for compression and a discharge outlet 44 is provided from discharge chamber 40 to direct compressed refrigerant to the refrigeration system.

As thus far described, scroll compressor 12 is typical of such scroll-type refrigeration compressors. In operation, suction gas directed to lower chamber 38 via suction inlet 42 is drawn into the moving fluid pockets 22 and 24 as orbiting scroll member 14 orbits with respect to non-orbiting scroll member 16. As the moving fluid pockets 22 and 24 move inwardly, this suction gas is compressed and subsequently discharged into discharge chamber 40 via a center discharge passage 46 in non-orbiting scroll member 16 and discharge opening 48 in muffler plate 36. Compressed refrigerant is then supplied to the refrigeration system via discharge outlet 44.

In selecting a refrigeration compressor for a particular application, one would normally choose a compressor having sufficient capacity to provide adequate refrigerant flow for the most adverse operating conditions to be anticipated for that application and may select a slightly larger capacity to provide an extra margin of safety. However, such "worst case" adverse conditions are rarely encountered during actual operation and thus this excess capacity of the compressor results in operation of the compressor under lightly loaded conditions for a high percentage of its operating time. Such operation results in reducing overall operating efficiency of the system. Accordingly, in order to improve the overall operating efficiency under generally encountered operating conditions while still enabling the refrigeration compressor to accommodate the "worst case" operating conditions, compressor 10 is provided with a capacity modulation system.

Figure 2:
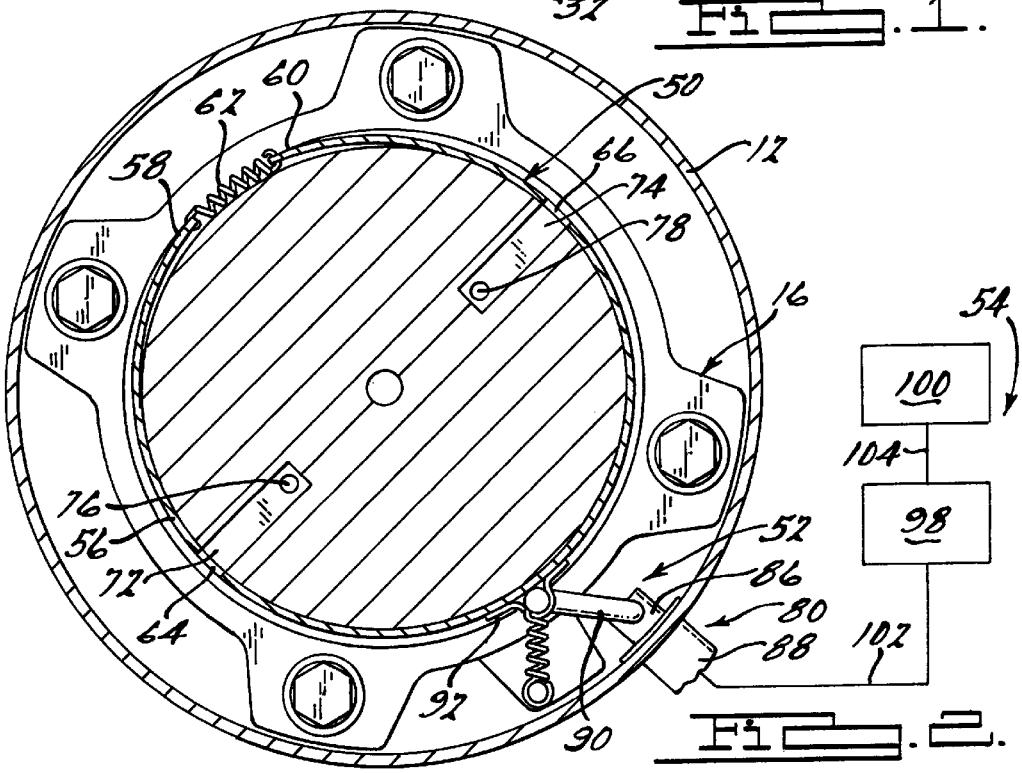
FIG. 2 is a section view of the compressor of FIG. 1, the section being taken along the line 2—2 thereof.

The capacity modulation system of the present invention includes a generally circularly shaped valving ring 50 movably mounted on non-orbiting scroll member 16, an actuating assembly 52 and a control system 54 for controlling operation of the actuating assembly (see FIG. 2).

Figure 3:
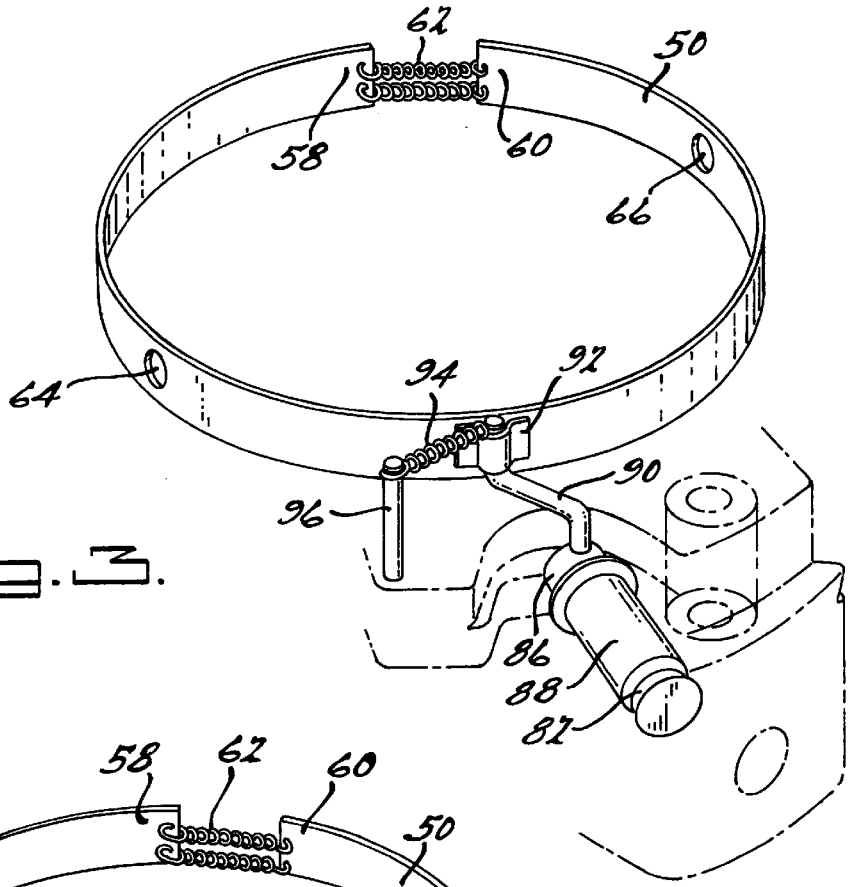
FIGS. 3 and 4 are views of the valving ring and actuator incorporated in the embodiment shown in FIGS. 1 and 2 shown in closed and open positions respectively.
Figure 4:
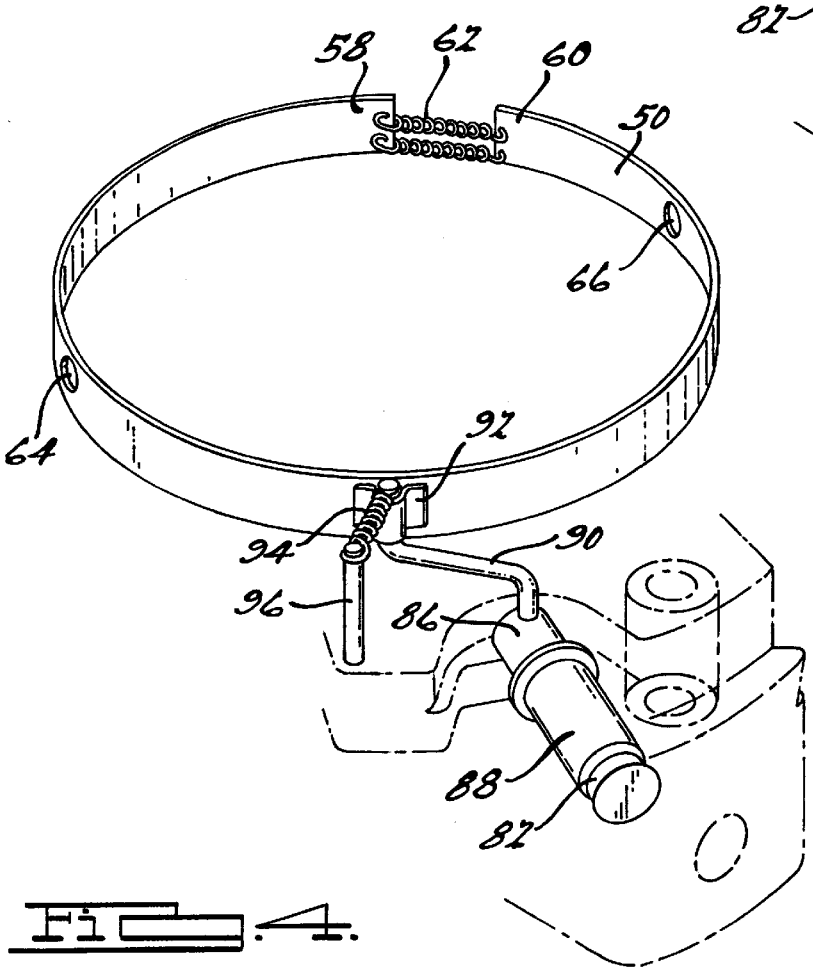
Figure 8:
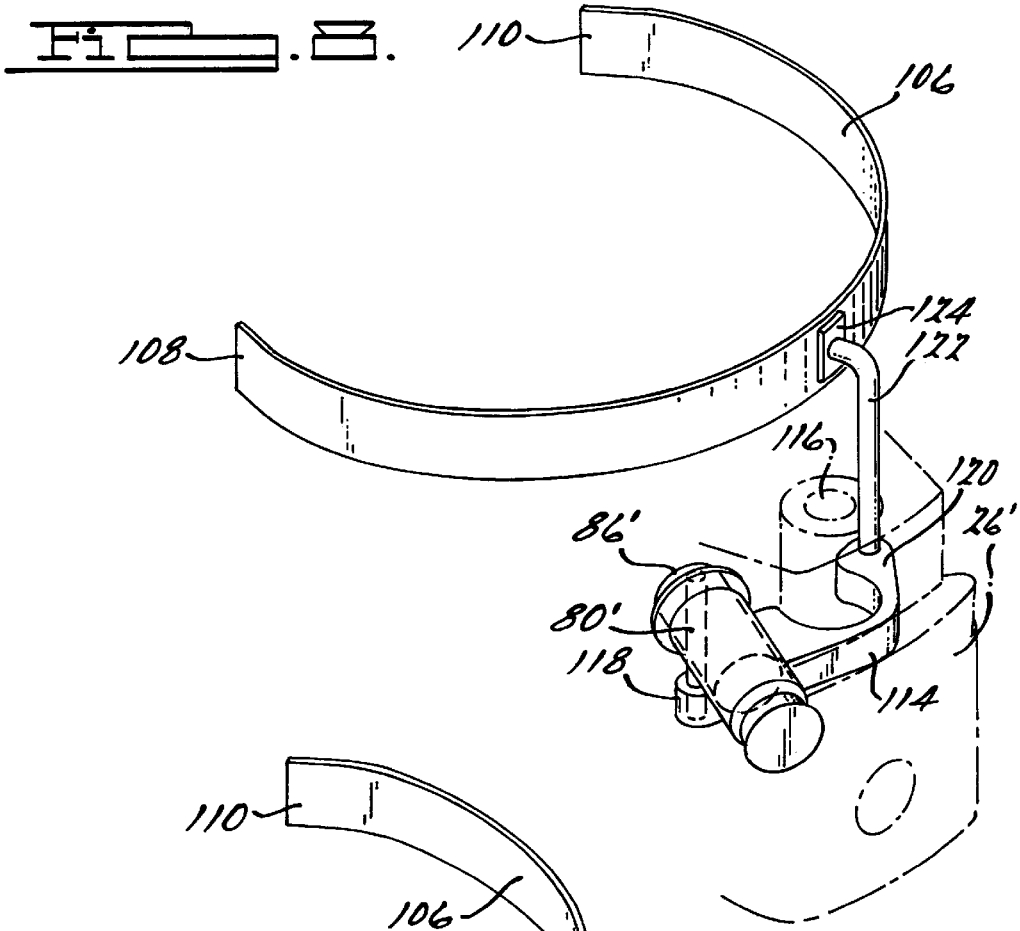
FIGS. 7 and 8 are views similar to that of FIGS. 3 and 4 but showing the embodiment illustrated in FIGS. 5 and 6.
Figure 7:
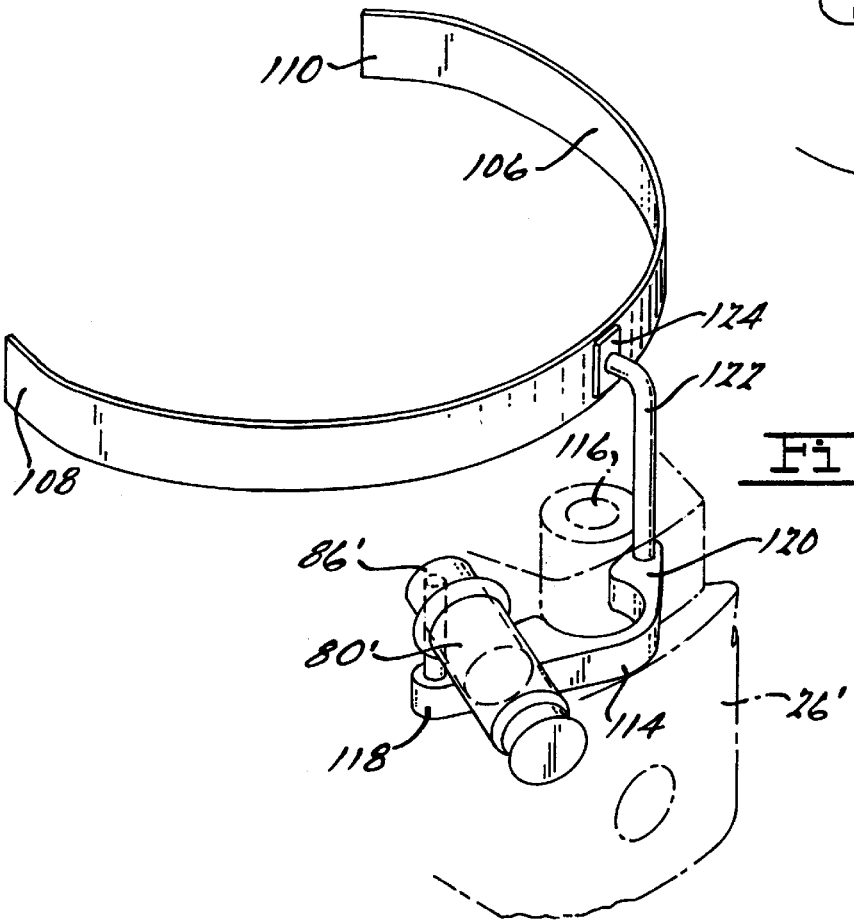

As best seen with reference to FIGS. 2 through 4, valving ring 50 comprises an elongated strip member 56 formed into a generally circular shape with the opposite ends 58 and 60 thereof being positioned in spaced generally opposed relationship. One or more springs 62 is provided having opposite ends connected to respective ends 58 and 60 of strip 56 and operates to draw them toward each other. Preferably ring 50 will be formed from a relatively thin metal and formed to a generally circular shape having a radius slightly less than the radius of non-orbiting scroll member. A pair of openings 64, 66 are provided in ring 50 positioned intermediate the ends thereof and in generally diametrically opposed relationship to each other.

As previously mentioned, valving ring 50 is designed to be movably mounted on non-orbiting scroll member 16. In order to accommodate valving ring 50, non-orbiting scroll member 16 includes a radially outwardly facing cylindrical sidewall portion 68 thereon having an annular groove 70 formed therein adjacent the upper end thereof.

Groove 70 is sized to movably accommodate ring 50 when it is assembled thereto having a relatively shallow radial depth approximately equal to or slightly greater than the thickness of ring 50 and an axial width just slightly greater than ring 50. Ring 50 may be easily assembled to non-orbiting scroll member 16 by merely spreading the ends apart slightly to enlarge the diameter thereof and slipping it axially into position within groove 70. Once in position, springs 62 will operate to bias ends 58 and 60 toward each other thereby retaining ring 50 properly seated within groove 70. Alternatively, ring 50 may be fabricated in a circular shape from a material having a suitable resilient shape retaining capability so as to enable it to be expanded for assembly yet still be sufficiently resistant to such radial expansion once assembled as to eliminate the need for springs 62. Of course this resistance to radial expansion must be sufficient as to enable ring 50 to maintain a seal over the capacity modulating vent passages described below when in a position for full capacity operation.

Non-orbiting scroll member 16 also includes a pair of generally diametrically opposed radially extending passages 72 and 74 opening into the inner surface of groove 70 and extending generally radially inwardly through the end plate of non-orbiting scroll member 16. An axially extending passage 76 places the inner end of passage 72 in fluid communication with moving fluid pocket 24 while a second axially extending passage 78 places the inner end of passage 74 in fluid communication with moving fluid pocket 22. Preferably, passages 76 and 78 will be oval in shape so as to maximize the size of the opening thereof without having a width greater than the width of the wrap of the orbiting scroll member 14. Passage 76 is positioned adjacent an inner sidewall surface of scroll wrap 20 and passage 78 is positioned adjacent an outer sidewall surface of wrap 20. Alternatively passages 76 and 78 may be round if desired however the diameter thereof should be such that the opening does not extend to the radially inner side of the wrap 18 of the orbiting scroll member 14 as it passes thereover.

Actuating assembly 52 includes a solenoid 80 having a cylindrical housing 82 sealingly secured to outer shell 12 and extending generally radially outwardly therefrom which defines a cylinder within which elongated piston 86 is axially movably disposed. An actuating coil assembly 88 is provided on the outwardly projecting portion of cylindrical housing 82 and serves to create a magnetic field when actuated drawing piston axially into cylinder housing 82. A generally Z-shaped actuating rod 90 has one end rotatably secured to the outer end of piston 86 with the other end being rotatably secured to the outer surface of valving ring 50 in a suitable manner such as by strap 92. As shown in FIGS. 3 and 4, actuating rod is secured to valving ring 50 at a location circumferentially displaced from the axis of piston 86 such that as piston 86 is drawn axially into cylinder 82, actuating rod 90 will rotate with respect thereto with the end secured to valving ring moving circumferentially toward the line of movement of piston 86 and thus effecting circumferential movement of ring 50.

As shown in FIG. 2, when solenoid coil 88 is de-energized, valving ring 50 will be in a position in which openings 64 and 66 are in alignment with respective passages 72 and 74 thereby venting compression chambers 22 and 24 to the interior of shell 12. When solenoid coil assembly 88 is energized, piston 86 will be drawn into cylinder housing 82 thereby effecting rotary movement of valving ring 50 with respect to non-orbiting scroll member 16 and moving openings 64 and 66 out of alignment with respective passages 72 and 74. In this position, valving ring 50 will prevent suction gas from respective compression chambers 22 and 24 being vented to the interior of the shell so that the compressor will then operate at substantially full capacity.

In order to return valving ring 50 to a position in which passages 64 and 66 are vented to the interior of the shell when solenoid coil 88 is de-energized, a spring 94 is provided having one end secured to a post 96 upstanding from main bearing housing 26 and the other end secured to the end of actuating rod 90 that is secured to valving ring. Thus when solenoid coil 88 is de-energized, spring 94 will operate to rotate valving ring in the opposite circumferential direction to move openings 64 and 66 back into aligned relationship with respective passages 72 and 74 as well as to move piston 86 axially outwardly from cylinder housing 82.

Control system 54 operates to control actuation of actuating assembly 52 and includes a control module 98 and one or more sensors 100. Control module 98 is connected to solenoid coil 88 via line 102 and operates to selectively energize solenoid coil 88 in response to system operating conditions as sensed by sensors 100 and transmitted thereto via line 104. Preferably, control module 98 will operate to ensure that solenoid coil 88 is de-energized both just prior to shut down of compressor 10 as well as at start up.

When valving ring 50 is in the position shown in FIG. 2, moving fluid pockets 22 and 24 will remain in fluid communication with lower chamber 38 at suction pressure via passages 72, 76 and 74, 78 after the initial sealing of the flank surfaces of the scroll wraps at the outer end thereof until such time as the moving fluid pockets have moved inwardly to a point at which they are no longer in fluid communication with passages 76 and 78. Thus, when valving ring 50 is in a position such that fluid passages 72 and 74 are in open communication with the suction gas chamber 38, the effective working length of scroll wraps 18 and 20 is reduced as is the compression ratio and hence the capacity of the compressor. It should be noted that the degree of modulation or reduction in compressor capacity may be selected within a given range based upon the positioning of passages 76 and 78. These passages will preferably be located so that they are in communication with the respective suction pockets at any point up to 360° inwardly from the point at which the trailing flank surfaces move into sealing engagement. If they are located further inwardly than this, compression of the fluid in the pockets will have begun and hence venting thereof will result in lost work and a reduction in efficiency.

It should also be noted that by ensuring passages 72 and 74 are in open communication with suction pressure at start up, the required starting torque for the compressor is substantially reduced. This enables the use of a more efficient lower starting torque motor, thus further contributing to overall system efficiency.

In any event, so long as system conditions as received by control module 98 indicate, compressor 10 will continue to operate in this reduced capacity mode. However, should system conditions dictate that additional capacity is required such as may be indicated by a signal from sensor 100 to controller 98, controller 98 will actuate solenoid valve 80 causing valving ring 50 to rotate in a clockwise direction as shown in FIG. 2 so as to substantially simultaneously close off passages 72 and 74 thereby avoiding the possibility of pressure imbalances between fluid pockets 22 and 24. With valving ring 50 in this position, it overlies and closes off passages 72 and 74 respectively thus preventing further venting of the suction fluid pockets therethrough and increasing the capacity of compressor 10 to its full rated capacity. So long as system operating conditions require, solenoid valve will be maintained in its energized position thereby maintaining compressor 10 at its full rated capacity. It should be noted that because the solenoid valve is selected to be in a normal position to reduce the capacity of the compressor, failure of either the solenoid valve or control module will not prevent continued operation of the compressor.

It should be noted that if desired the actuating solenoid valve assembly may be replaced by a pressure actuated piston assembly. In such an embodiment, it is contemplated that a solenoid valve would be incorporated to control flow of pressurized fluid to and venting from the actuating piston/cylinder. It is also contemplated that the discharge fluid would be utilized as the pressurized fluid to actuate the piston cylinder assembly in such an embodiment.

Another embodiment of a modulation system in accordance with the present invention is illustrated and will be described with reference to FIGS. 5 through 8. As this embodiment is very similar to the embodiment shown in FIGS. 1 through 4 except for the valving ring and a portion of the actuating mechanism as noted below, corresponding portions will be indicated by the same reference numbers used in FIGS. 1 through 4 primed.

In this embodiment valving ring 106 is fabricated from a suitable resilient shape retaining material such as spring steel and has a generally circular shape extending circumferentially somewhat greater than 180° . The opposite ends 108 and 110 of valving ring 106 are spaced apart approximately 90° and flare slightly radially outwardly. Preferably, valving ring 106 will have an unstressed diameter slightly less than that of the diameter of groove 70' provided in non-orbiting scroll 16' within which it is seated.

Actuating mechanism 112 is similar to actuating mechanism 80 in that it utilizes a solenoid actuated plunger to effect movement of valving ring 106. However, a rocker arm 114 is pivotably supported on main bearing housing 26' by means of a suitable pivot pin 116. Rocker arm 114 includes a first arm 118 extending outwardly from pivot pin 116, the outer end of which is pivotably connected to the outwardly projecting end of plunger 86'. A second arm 120 extending outwardly from pivot pin 116 in generally the opposite direction from arm 118 is adapted to pivotably receive one end of an actuating rod 122. The other end of actuating rod 122 is fixedly secured to the outer periphery of valving ring 106 via strap 124 such as by welding. Preferably, valving ring 106 will be positioned relative to non-orbiting scroll member 16' such that the midpoint thereof is substantially centered with respect to diametrically opposed vent passages 72' and 74' and actuating rod will be secured thereto at this midpoint location.

In operation, when solenoid coil 80' is de-energized valving ring will be in a position as shown in FIG. 5 in which the midpoint portion thereof is positioned in radially spaced relationship to non-orbiting scroll member 16' with the opposite ends thereof being positioned within groove 70'. When in this position, vent passages 72' and 74' will both be in open communication with chamber 38 which is at suction gas pressure as valving ring will be radially outwardly spaced therefrom as shown in the drawings. Thus, the compressor will operate at a reduced capacity.

Should conditions indicate that increased capacity is required, solenoid valve 80' will be energized by the control module in response to signals from system load sensors. Energization of solenoid valve 80' will result in plunger being drawn radially outwardly with respect to compressor 10' thereby causing rocker arm 114 to pivot about pin 116 in a clockwise direction to a position as shown in FIG. 6. This pivoting motion of rocker arm 114 will in turn move valving ring 106 radially inwardly with respect to non-orbiting scroll member 16' such that it is fully seated within groove 70'. In this position valve ring 106 will be in overlying relationship to respective vent passages 72' and 74' and will operate to prevent venting of suction gas therethrough. Thus, the compressor will operate at substantially full capacity until such time as the sensors indicate it can be returned to reduced capacity.

It should be noted that because the opposite ends of valving ring 106 extend more than 90° in opposite directions from the radial line of movement of actuating rod 122, the radially inwardly directed biasing force exerted by opposite end portions 108 and 110 on the radially outwardly facing curved surface of groove 70 will operate to assist solenoid coil 80' in moving valving ring 106 into a closed position. Further, the slight radially outward flare provided on end portions 108 and 110 ensures that the radially inner edges at the opposite terminal ends of valving ring 106 will not dig into the groove 70 and thereby resist movement into a closed non-venting position. While the circumferential extent of valving ring 106 is not critical, it should be sufficient to ensure that it will expand radially enough to uncover passages 72' and 74' so that the compression pockets may be vented to the low pressure chamber of the compressor.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A capacity modulation system for a scroll-type compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position;

a first fluid passage provided in said first scroll member and extending generally radially from one of said at least two moving fluid pockets to a radially outer peripheral surface of said first scroll member;

a second fluid passage provided in said first scroll member and extending generally radially from a second of said at least two moving fluid pockets to a radially outer peripheral surface of said first scroll member; and an elongated member having opposite ends and extending circumferentially around a portion of said first scroll member, said portion being less than the full circumference of said first scroll member, said elongated member being movable between a first position in which said first and second fluid passages are in open communication with an area at substantially suction pressure and a second position in which communication of said first and second passages with said area at substantially suction pressure is resisted.

2. A capacity modulation system as set forth in claim 1 further including an actuating assembly, said actuating assembly being operative to move said elongated member to said second position when energized and to said first position when deenergized.

3. A capacity modulation system as set forth in claim 2 wherein said actuating assembly is de-energized when said compressor is started thereby enabling use of a lower starting torque motor for driving said compressor.

4. A capacity modulation system as set forth in claim 2 wherein said actuating assembly is de-energized when said compressor is shut down.

5. A capacity modulation system as set forth in claim 2 wherein said actuating assembly includes a solenoid for affecting movement of said elongated member.

6. A capacity modulation system as set forth in claim 5 wherein said actuating assembly includes a member pivotably interconnecting said solenoid and said elongated member.

7. A capacity modulation system as set forth in claim 6 wherein said actuating assembly includes a biasing member operative to return said elongated member to said first position when said solenoid coil is deenergized.

8. A capacity modulation system as set forth in claim 1 further comprising biasing means extending between opposite ends of said elongated member, said biasing means being operative to urge said opposite ends toward each other.

9. A capacity modulation system as set forth in claim 8 wherein said elongated member is circumferentially movably supported on said first scroll member.

10. A capacity modulation system as set forth in claim 5 wherein said elongated member includes openings movable into and out of overlying relationship with said first and second passages.

11. A capacity modulation system as set forth in claim 1 wherein said elongated member is formed of a resilient material operable to exert a radially inwardly directed force on said first scroll member.

12. A capacity modulation system as set forth in claim 11 wherein said elongated member is radially movable between said first and second positions.

13. A scroll-type refrigeration compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position;

a stationary body supporting said second scroll member for orbital movement with respect to said first scroll member, said first scroll member being supportingly secured to said stationary body;

a drive shaft rotatably supported by said stationary body and drivingly coupled to said second scroll member;

a driving motor operative to rotatably drive said drive shaft;

a first fluid passage provided in said first scroll member and extending generally radially from a first fluid pocket and opening outwardly along an outer peripheral surface of said first scroll member;

a second fluid passage provided on said first scroll member and extending generally radially from a second fluid pocket and opening outwardly along an outer peripheral surface of said first scroll member, in circumferentially spaced relationship from said first passage;

an elongated member movably supported on and extending circumferentially around a portion of the outer periphery of said first scroll member, said elongated member including opposite ends positioned in circumferentially spaced relationship; and an actuating assembly operatively connected to said elongated member, said actuating assembly being operative to effect movement of said elongated member with respect to said first scroll member to selectively open and close said first and second fluid passages.

14. A scroll-type refrigeration compressor as set forth in claim 13 further comprising a hermetic shell, said first and second scroll members and said stationary body being disposed within said shell and said actuating assembly includes a solenoid having a cylindrical member extending outwardly from said shell, an actuating coil supported on an outer surface of said cylindrical member and a plunger movably disposed within said cylinder and projecting into said shell.

15. A scroll-type refrigeration compressor as set forth in claim 14 wherein said actuating assembly includes a rod pivotably connected to said elongated member and said plunger, said rod being operative to effect rotary movement of said elongated member.

16. A scroll-type refrigeration compressor as set forth in claim 15 wherein said elongated member includes first and second circumferentially spaced openings, said openings being movable into and out of alignment with said first and second fluid passages.

17. A scroll-type refrigeration compressor as set forth in claim 16 further comprising a resilient member extending between said opposite ends.

18. A scroll-type refrigeration compressor as set forth in claim 14 wherein said elongated member is radially movable.

19. A scroll-type refrigeration compressor as set forth in claim 18 wherein said actuating assembly includes a rocker arm pivotably supported within said shell, one end of said rocker arm being connected to said elongated member and the other end being connected to said plunger.

* * * * *

UNITED STATES PATENT AND TRADEMARK OFFICE

CERTIFICATE OF CORRECTION

PATENT NO. : 6,176,686 B1
DATED : January 23, 2001
INVENTOR(S) : Frank S. Wallis et al.

It is certified that error appears in the above-identified patent and that said Letters Patent is hereby corrected as shown below:

Column 8,
Line 22, "5" should be -- 8 --.

Signed and Sealed this

Twenty-fourth Day of December, 2002

JAMES E. ROGAN
*Director of the United States Patent and Trademark Office*